US005838002A

United States Patent [19]

Sheehan

[11] Patent Number: 5,838,002

[45] Date of Patent: Nov. 17, 1998

[54] METHOD AND APPARATUS FOR IMPROVED ELECTROSPRAY ANALYSIS

[75] Inventor: Edward W. Sheehan, Pittsburgh, Pa.

[73] Assignee: Chem-Space Associates, Inc, Pittsburgh, Pa.

[21] Appl. No.: 701,050

[22] Filed: Aug. 21, 1996

[51] Int. Cl.[6] ..... H01J 49/10

[52] U.S. Cl. ..... 250/288; 250/281; 250/282

[58] Field of Search ..... 250/288, 281, 250/282, 288 A, 423 R

[56] References Cited

U.S. PATENT DOCUMENTS

| | | | |
|---|---|---|---|
| 4,160,161 | 7/1979 | Horton | 250/281 |
| 4,999,493 | 3/1991 | Allen et al. | 250/288 |
| 5,015,845 | 5/1991 | Allen et al. | 250/288 |
| 5,115,131 | 5/1992 | Jorgenson et al. | 250/288 |
| 5,393,975 | 2/1995 | Hail et al. | 250/288 |

FOREIGN PATENT DOCUMENTS

| | | |
|---|---|---|
| 1246709 | 9/1971 | United Kingdom . |
| 07465 | 4/1993 | WIPO . |
| 34089 | 12/1995 | WIPO . |

OTHER PUBLICATIONS

Dohmier, D.M.; Open tubular liquid chromotography: Studies in column efficiency and detection, Chap 4, pp. 92–172 (Thesis, 1992). Has no month.

Cook, K.D.; Electrohydrodynamic mass spectrometry, Mass Spec. Rev. 1986 5, pp. 467–519. Has no month.

Dulcks and Rollgen; Ion source for electrohydrodynamic mass spectrometry, J. Mass Spectom., 1995, 30, pp. 324–332. Has no month.

Mahoney, Perel, Lee and Legesse; A theoretical and experimental basis for producing very high biomolecular ions by EHD emission, IEEE, Oct. 1987, pp. 1–6.

Lee, Legesse, Mahoney and Perel; An EHD source for the mass spectral analysis of peptides, ASMS Conference, Jun. 1988.

Lee, Legesse, Mahoney, Perel; Electrohydrodynamic emission mass spectra of peptides, ASMS Conference, May 1989, pp. 1196–1197.

Mahoney et al.; Electrhydrodynamic ion source design for mass spectrometry: Ionization, ion optics and desolvation, ASMS Confer. pp. 548–549 Jun. 1990.

Grace and Marijnissen; A review of liquid atomization by electrical means, J. Aerosol Sci. 1994, 25, pp. 1005–1019.

Luttgens, Dulcks, Rollgen; Field Induced disintegration of glycerol solutions under vacuum and atmospheric . . . , Surf. Sci. 1992, 266, pp. 197–203.

*Primary Examiner*—Kiet T. Nguyen

[57] ABSTRACT

An electrospray ion production method and ion source designed to reduce overall gas load on the vacuum system and enhance the ion production and collection efficiencies. This ion source is for gas phase ion analysis of constituents dissolved in liquid solution comprising a needle (10) held at high electrical potential through which the solution flows into a first chamber (1) maintained at reduced pressure, forming a highly charged liquid cone-jet. The highly charged liquid jet is steered, in the first chamber, on-axis with an aperture into a second chamber (2) maintained at higher pressure than that of the first chamber. The second chamber is heated and pressurized to facilitate desolvation of the solution droplets originating from the breakup of the highly charged jet, resulting in the production of gas phase ions by the electrospray ionization process. The gas phase ions are then sampled and detected. Alternative reactions and/or inputs of energy via collision and/or radiation may occur in the second chamber to further facilitate ion production or fragmentation and may further enhance sample identification. This method and device may be useful in the implementation of liquid chromatography-mass spectrometry.

33 Claims, 4 Drawing Sheets

METHOD AND APPARATUS FOR IMPROVED ELECTROSPRAY ANALYSIS

TECHNICAL FIELD

This invention relates to a method and apparatus for electrospraying solutions of chemical species for detection in gas phase ion detectors from liquid solutions, particularly chemical species that are separated and detected with liquid chromatography-mass spectrometry.

BACKGROUND ART

The production of intact gas phase ions from compounds dissolved in solution has been a topic of considerable attention for some time, particularly in liquid chromatography-mass spectrometry.[1] Typically, the ion production process has been problematic for labile and/or high molecular weight compounds because, in many cases, the energy input to facilitate a phase change from liquid to the gas resulted in chemical reactions, rearrangements or degradation of the analyte of interest. Many compounds separated with liquid chromatography fall into this category. In recent years electrospray (ES) and electrohydrodynamic processes (EHD) have successfully demonstrated capabilities for ion production with both labile and high molecular weight compounds.[2]6 The terms electrospray and electrohydrodynamic are sometimes used interchangeably. For the present discussion we will referred to both processes as electrospray and restrict our definition to sprays in which conical deformation of the liquid occurs as a result of high electrical potential. This is referred to as the cone-jet mode of electrospray.

The mechanism of ion production in ES has been the subject of considerable debate over the years.[7] The characteristic geometry of ES aerosol and ion generators is the simple cone-jet [8] as seen in FIG. 1. We can summarize the process of electrospray by describing each part of the spray as labeled. A conducting liquid usually emerges from a capillary tube held at high electrical potential (Region A). The liquid accelerates toward a counterelectrode and assumes the characteristic conical geometry (Region B). At the apex of the cone, a high velocity jet emerges (Region C) which subsequently breaks into highly charged droplets (Region D). The highly charged droplets in Region D are generally evaporated with dry gas[5] or heat[9] to produce further breakup of the liquid and formation of gas phase ionic species. In some instances ions are emitted directly from the apex of the cone instead of a jet, particularly with liquid metal emittors.[10] Cone-jet aerosol sources have been utilized for a number of applications; including, mass spectrometry sample introduction and ionization,[5,11] particle generation,[12] and thruster technology,[13] and liquid metal ion sources.[10] . The operation of cone-jet source of aerosols has been demonstrated at atmospheric [14] -[17] and at reduced pressure.[10,18]

The production of ions from an ES source has demonstrated extremely good applicability for compounds that are labile and/or high molecular weight. Typically ES ion sources are operated at atmospheric pressure because of the efficient heat transfer at these pressures to the charged droplets which results in the evaporation of the primary droplets and concomitantly causes efficient ion production. Unfortunately, at atmospheric pressure only a fraction of the ions produced are actually sampled into the low pressure detectors because of the difficulty of focusing and sampling ions through small sampling apertures to reduced pressures. Larger apertures are sometimes used to improve sampling efficiencies; however, these require more costly and/or higher capacity pumping on the vacuum system to maintain acceptable detector operating pressures. Another limitation of atmospheric pressure ES operation is the threshold of electrical discharge across the gap between the high electrical potential capillary and the counterelectrode. This threshold is generally a function of capillary and counterelectrode spacing and geometry, surrounding gas composition, and pressure. The operating voltages are limited by the discharge threshold due to partial or complete degradation of the electrospray process during an electrical discharge. Discharges generally present a greater limitation while operating atmospheric pressure ES sources in the negative ion mode. [19,20]

The operation of ES processes at reduced pressures has allowed scientists to reduce the total gas load on the vacuum system. The operating pressure must be sufficiently low to prevent electrical discharge.[21] Experimental results with ES at low pressure have demonstrated (1) instability of the liquid cone-jet resulting in the formation of multiple swirling cone-jets; (2) instability in the directionality of the resulting liquid jet; (3) freezing and (4) boiling of the liquid cone at the end of the capillary; (5) a high degree of solvent clustering of the ions leaving the electrospray cone; and (6) gas phase ions possessing a wide spread in kinetic energy making the collection and focusing of the ions difficult.[2-6,18,21] Solvent clustering, along with the divergence of the droplets from the axis of the tip of the liquid cone, freezing and boiling of the liquid cone and instability of the electrospray cone have made ion detection in the low pressure mode of operation irreproducible and difficult to interpret.

Practioners of EHD minimize the problem of freezing and boiling by dissolving there analyte in a non-volatile solvent, such as glycerine, and introducing sample into a vacuum chamber at reduced flow rates (nanoliters/min). Some low pressure ES devices included various lenses for controlling the ions (not droplets) downstream from ES needle.[3,4,6,18] Prior related art can be divided into four (4) groups:

1. low pressure electrospray without a focusing means for sampling into a low pressure detector (such as, references 4 and 23);

2. low pressure electrospray with a focusing means for directing the aerosol into low pressure detectors (such as, references 3 and 6);

3. low pressure electrospray with a focusing means for directing aerosol into a high pressure declustering region (such as, reference 6); and 4. low pressure electrospray without a focusing means and sampling the aerosol into a high pressure ionization region (such as, reference 22).

The art of Mahoney and coworkers [6] addresses declustering downstream from the spray but does not effectively deal with the evaporation of droplets produced at low pressure.

Platzer[22] addresses the problem of solvent declustering and wide kinetic energy spread at low pressures by directly spraying from low pressures through a heated tube into a higher pressure ionization region. The art of Platzer fails to address the inherent instability of the primary electrospray process, freezing and boiling in a vacuum; and the wide angular and spatial dispersion of the spray. The primary outcome of failing to address the low pressure spray stability will result in significant losses of analyte and droplets on the walls of their first chamber and the heated transfer tube. Although, they may collect some of the spray through the tube by virtue of large cross sectional diameters, they will still have irreproducible and unstable signal resulting from the unstable spray processes.

The object of the current invention is to overcome the aforementioned limitations of both atmospheric pressure and low pressure operations of electrospray.

REFERENCES

1. Neissen, W. M. A.; van der Greef, J. Liquid chromatography-Mass Spectrometry, Principles and Applications, Dekker: New York, 1992.
2. Smith, D. P. H. IEEE Trans. Ind. Appl. 1986, IA-22, 527–535. *The electrohydrodynamic atomization of liquids.*
3. Cook, K. D. Mass Spect. Rev. 1986 5, 467–519. *Electrohydrodynamic mass spectrometry.*
4. Duelcks, T., Roeligen, F. W. J. Mass Spectrom. 1995 30, 324–332. *Ion source for electrohydrodynamic mass spectrometry.*
5. (a) Fenn, J. B.; Mann, M.; Meng, C. K.; Wong, S. F.; Whitehouse, C. M. Science 1989, 246, 64–70. *Electrospray ionization for mass spectrometry of large biomolecules. (b) Fenn, J. B.; Mann, M.; Meng, C. K.; Wong, S. F.; Whitehouse, C. M. Mass Spectrom. Rev.* 1990, 9, 37–70. *Electrospray ionization-principles and practice.*
6. (a) Mahoney, J. F., Perel, J., Lee, T. D., Legesse, K.; A theoretical and experimental basis for producing very high mass biomolecular ions by electrohydrodynamic emission; presented at the 27th IEEE Industry Applications Society Annual Meeting, Atlanta, Ga, Oct. 18–23, 1987. (b) Lee, T. D., Legesse, K., Mahoney, J. F., Perel, J.; An EHD source for the mass spectral analysis of peptides; Proceedings of the 36th ASMS Conference on Mass Spectrometry and Allied Topics, San Francisco, Calif. Jun. 5–10, 1988. (c) Lee, T. D., Legesse, K., Mahoney, J. F., Perel, J.; Electrohydrodynamic emission mass spectra of peptides; Proceedings of the 37th ASMS Conference on Mass Spectrometry and Allied Topics, Miami Beach, FL, May 21–26, 1989. (d) Mahoney, J. F., Perel, J., Lee, T. D., Husain, S., Todd, P. J., Cook, K.; Electrohydrodynamic ion source design for mass spectrometry: Ionization, ion optics and desolvation; Proceedings of the 38th ASMS Conference on Mass Spectrometry and Allied Topics, Tucson, AR, Jun. 3–8, 1990.
7. lkonomou, M. G.; Blades, A. T.; Kebarle, P. Anal. Chem. 1991, 63, 1989–1996. *Electrospray-ion spray: A comparison of mechanisms and performance.*
8. Grace, J. M.; Marijinissen, J. C. M. J. Aerosol Sci. 1994, 25, 1005–1019. *A Review of liquid atomization by electrical means.*
9. Chowdhury, S. K., Viswanatham, K., Chait, B. T. Rapid Comm. Mass Spectrom. 1990, 4, 81–87. *An electrospray ionization mass spectrometer with new features.*
10. Prewett, P. D.; Mair, G. L. R. Focused Ion Beams from Liquid Metal Ion Sources; Research Studies Press, Ltd.: Somerset, England, 1991.
11. Kebarle, P. and Tang, L. Anal. Chem. 1993, 65, 972A–986A. From ions in solution to ions in the gas phase, *The mechanism of electrospray mass spectrometry.*
12. Lewis, K. C., Dohmeier, D. M., Jorgenson, J. W., Kaufman, S. L., Zarrin, F., Dorman, F. D., Anal. Chem. 1994, 66, 2285–2292. *Electrospray-condensation particle counter, A molecule-counting LC detector for macromolecules.*
13. Bailey, A. G. (ed.) "Chapter 8 Further Applications of Charged Drops", pp. 171–176, IN Electrostatic Spraying of Liquids, Research Studies Press Ltd.: Somerset, England, 1988.
14. Zeleny, J. Proc. Camb. Phil. Soc, 1915, 18, 71–83. On the conditions of instability of electrified drops, with applications to the electrical discharge from liquid points. (b) Zeleny, J. Phys. Rev. 1917, 10,1–6. *Instability of electrified liquid surfaces.*
15. Taylor, G. I. Proc. R. Soc. 1969, A313, 453–475. *Electrically driven jets.*
16. de la Mora, J. F., Loscertales, I. G. J. Fluid Mech. 1994, 260, 155–184. *The current emitted by highly conducting Taylor Cones.*
17. (a) Gomez, A., Tang, K. Phys. Fluids 1994,6, 404–414. Charge and fission of droplets in electrostatic sprays. (b) Gomez, A., Tang, K. Phys. Fluids 1994,6, 2317–2332. *On the structure of an electrostatic spray of monodisperse droplets.*
18. Luttgens, U., Dulcks, T., Roligen, F. W. Surface Science 1992, 266,197–203. Field induced disintegration of glycerol solutions under vacuum and atmospheric pressure conditions studied by optical microscopy and mass spectrometry.
19. Le Blanc, J. C. Y.; Guevremont, R.; Siu, K. W. M. 1993, Int. J. Mass Spectrom. Ion Proc. in press. Electrospray mass spectrometry of some proteins and the aqueous solution acid/base equilibrium model in the negative ion detection mode.
20. Ikonomou, M. G.; Blades, A. T.; Kebarle, P. J. Am. Soc. Mass Spectrom. 1991, 2, 497–505. Electrospray mass spectrometry of methanol and water solutions suppression of electric discharge with $SF_6$ gas.
21. Dohmeier, D. M., Ph.D. Dissertation, University of North Carolina, Chapel Hill, N.C. 1991; Chapter 4, Electrospray in vacuum as a potential interface between open tubular liquid chromatography and mass spectrometry; pp. 92–172; IN: Open tubular liquid chromatography: Studies in column efficiency and detection.
22. Platzer, B.; "Process and device for feeding liquid samples to mass spectrometers by electrostatic nebulisation," WO Patent 95/34089 (Dec. 14, 1995).
23. Jorgenson, J. W. and Dohmeier, D. M.; "Microelectrospray method and apparatus", U.S. Pat. No. 5,115,131 (May 19, 1992).
24. Fenn, J. B., Yamashita, M., Whitehouse, C.; "Process and apparatus for changing the energy of charged particles contained in a gaseous medium", U.S. Pat. No. 4,542,293 (Sep. 17, 1985).
25. Rayleigh, Lord Proc. Phil. Mag. Series, 1882, 5, 184–186. *On the equilibrium of liquid conducting masses charged with electricity.*

SUMMARY OF INVENTION

The current invention is intended to overcome many of the aforementioned limitations of conventional atmospheric pressure electrospray and low pressure electrohydrodynamic (EHD) devices by physically separating the primary aerosol generation process from the secondary aerosol and ion generation processes and discretely optimizing both. The primary process of cone-jet formation is controlled by thermal and electrostatic means to facilitate the formation of a directionally stable liquid cone-jet. Once a stable cone-jet is formed, the jet and resulting droplets are introduced into a evaporation region where the secondary aerosol is generated and the ion generating processes take place.

A liquid solution is introduced through a needle, held at high electrical potential, into a first chamber maintained at reduced pressure to produce a stable electrospray cone-jet. The product of this primary process is intended to be a highly charged liquid jet and droplets from an electrospray source directed on the axis of a counterelectrode (see FIG. 1). In contrast, other devices used in low pressure ES systems are typically operated to produce ions directly from the primary cone.[43,4,6] The pressure in the first chamber of the present device is maintained below the pressure at which electrical discharge occurs, typically less than 0.1 Torr. Ancillary heating of the tube may be required in the first chamber to prevent freezing of the liquid from evaporative cooling.

The liquid cone-jet in the present device is stabilized by the electrostatic lens surrounding the capillary resulting in a constant (in time) conical geometry with a constant (in space) axial direction associated with the liquid jet. The liquid jet under influence of surface tension will break into droplets that will continue in the axial direction of the jet. The present invention takes advantage of the extremely small axial cross-section of the liquid jet and droplets and their high axial velocity, to sample all of this jet of liquid across a high pressure gradient through a small cross sectional aperture into a higher pressure region. The aperture size is selected for efficient transfer of liquid through the aperture and in order to maintain pressure requirements in both the first chamber (to prevent discharge) and the second chamber (to desolvate, breakup ion clusters, form ions, react species, and focus ions).

A key aspect of the present method of ion generation is the precise alignment of the liquid jet with the sampling aperture located in the wall of the first chamber leading into the second chamber. This alignment allows virtually all analyte in solution to be introduced into the second chamber. The alignment of the jet may be accomplished with either mechanical translational adjustment, and/or electrostatic or magnetic steering. The stability of the cone-jet is also dependent upon the geometry and spatial relationship of the stabilizing electrode; and the stability of the liquid flow.

Once the liquid jet is aligned with the aperture, the high velocity highly charged jet and primary droplets are introduced into the higher pressure chamber (the second chamber) in order to more efficiently conduct heat to the droplets causing the evaporation of the volatile components in the droplets. The extent of evaporation in the second chamber is regulated by a controlled heat supply, the gas composition, gas pressure and the geometry of the region. As the droplet decreases in size, due to the evaporation of the volatile components, the density of charges on the surface of the droplet increases, driving the highly charged droplets to the limit of charging, sometimes called the "Rayleigh limit".[25] At this point the primary droplets deform and emit secondary droplets, ion clusters, or ions. The secondary droplets undergo further evaporation and a subsequent emission of droplets, ion clusters and ions. The ions that leave the droplets may be highly solvated or clustered. Collision of ions and/or ion clusters with the residual background gas(es) or other ions in this higher pressure region will be sufficiently energetic to decluster the adducts and leave intact gas phase molecular ions formed from the electrospray process. These ions can then be focused, analyzed, and detected by conventional means, such as a mass spectrometer. Examples of mass spectrometers; include, (but are not limited to) time-of-flight, ion traps, fourier transform, quadrupole, magnetic sector, and tandem instruments.

Because the second chamber affords a degree of isolation of the ion generation processes from the primary droplet charging process, alternative operating conditions are compatible with the present device. For example, the second chamber can be pressurized with helium (a highly conductive gas) to induce efficient desolvation. This gas results in a gas discharge when used with conventional electrospray devices, at atmospheric pressure. Another example, would be the use of high energy sources, such as, dc and rf discharges, to augment both desolvation, ionization processes, and fragmentation. The second chamber could also serve as a reaction chamber for a variety of processes, as a collector or trap of selected ions for storage and/or subsequent analyze (e.g. quadrupole trap, potential well trap).

The restriction of the total mass flow into the vacuum system with the present devise significantly reduces the system pumping requirements when compared to conventional ES devices. The production of a stable cone-jet at reduced pressures minimizes the problems associated with gas discharge in atmospheric pressure modes of operation, particularly in negative ion mode. The collection of virtually the entire primary aerosol into a higher pressure region allows efficient ion production and declustering and eliminates problems associated with other low pressure ES devices, such as, spatial and directional instabilities and cluster formation. Since ion production occurs in close proximity to the mass analyzer or other gas phase ion detectors, the transport losses compared with atmospheric ES operation are not as significant.

DESCRIPTION OF THE PREFERRED EMBODIMENTS

Referring to FIG. 2, a preferred embodiment of the invention, which may be [but is not limited to] the effluent from a liquid chromatograph, flows within tube 17 in the direction of the arrow and all or a portion of the liquid is caused to flow out of capillary tube 10. Excess liquid flows out of splitter tube 16 in a flow splitter configuration. Insulator tube 15 joins onto tee 14 and is composed of an electrically insulating material. Insulator tube 15 is of sufficient length, internal diameter, and total resistance to maintain an electrical potential difference between the high voltage power supply and the liquid chromatograph, which is at ground. Tee 14 is composed of electrically conducting material, usually stainless steel. Tee 14 is connected to a high voltage power supply which can be regulated in terms of voltage, current, a combination of current and voltage, and possibly modulated. Tee 14 may be kept at several thousand volts, but is not limited to this. The portion of the liquid that flows through capillary tube 10 also flows into vacuum chamber 1, through a vacuum seal 13 composed of an electrically insulating material, such as glass, or lexan, which also provides mechanical support for capillary tube 10. Capillary tube 10 may be composed of an insulating or metallic material.

An electrode or coaxial cylindrical tube 11 is located coaxially to the capillary tube 10. For liquid cone-jet stability, electrode 11 is a coaxial cylindrical tube but not limited to this specific geometry (e.g., plate(s), quadrupole, octopole). Coaxial cylindrical tube 11 is composed of electrically conducting material, usually stainless steel. Coaxial cylindrical tube 11 is also at a high electrical potential which is adjustable to maintain a stable axial spray. Adjuster 12 is affixed to both tubes 10 and 11 and allows mechanical alignment of these tubes relative to one another and relative to the entrance lens 21.

FIG. 3 is an expanded view of the cone-jet region of the preferred embodiment. Liquid cone 76 emerges from the tip 9 of the capillary tube 10 and forms a liquid jet 19 moving in the direction of entrance lens 21. The alignment of the liquid jet 19 with exit or pinhole aperture 28 is performed with adjuster 12 to ensure the liquid flows into chamber 2.

As seen in FIG. 2, the second chamber 2 is separated from chamber 1 by means of an entrance lens 21 and skimmer lens 22. Inside chamber 2 is an additional focusing lens 20. All three lens are made of metal and serve as focusing lens for ions and charged particles. Entrance lens 21 is isolated from focusing lens 20 by insulator 23 and in turn, focusing lens 20 is isolated from chamber 2 by insulator 27. Skimmer lens 22 is isolated from chamber 2 by insulator 24. The housing of chamber 2 is made of metal and serves as a focusing lens for ions and charged particles contained in chamber 2. The volume, length and geometry is chosen to minimize surface losses of analyte and maximize transport of ions.

A conductive gas, such as nitrogen or helium but not limited to such gases, is added to chamber 2 through gas tube 52 from a gas supply source 50 in sufficient quantity to maintain chamber 2 at a pressure greater than either chambers 1 or 3. Gas tube 52 enters chamber 1 through vacuum feedthrough 53 and is electrically isolated from gas inlet tube 55 by means of an electrically insulating union 54. Electrically insulating union 54 is composed of a gas impermeable electrically insulating material such as glass, or ceramic but not limited to this specific material. Gas inlet tube 55 then joins chamber 2. Gas tube 52 and gas inlet tube 55 are made of a material impermeable to gas such as metal, but not limited to this specific material.

Gas may be removed from chamber 2 through pump out line 72. This pump out line 72 is pumped by a mechanical pump (not shown) to maintain an effective pressure in chamber 2 greater than either chambers 1 or 3. Pump out line 72 enters chamber 1 through vacuum feedthrough 73 and is electrically isolated from gas outlet tube 75 by an electrical insulating union 74. Electrically insulating union 74 is composed of a gas impermeable electrically insulating material such as glass, or ceramic but not limited to this specific material. Gas outlet tube 75 then joins chamber 2. Pump out line 72 and gas outlet tube 75 are made of a material impermeable to gas such as metal, but not limited to this specific material. The flow, pressure and composition of gas(es) into chamber 2 are controlled by a combination of the gas manifold (not shown), gas inlet valve 51, gas outlet valve 71, and sizes of apertures 28 and 29. Chamber 2 is heated by a heater cartridge 26 imbedded in the chamber wall 25, and a thermocouple (not shown) attached to the chamber indicates the temperature and couples to a temperature controller to adjust the heater power to maintain the desired temperature.

Ions, any residual charged droplets or particles and the added gas exit from chamber 2 through skimmer lens 22 located on axis with the entrance lens 21 into chamber 1. Skimmer lens 22 is electrically isolated from the chamber 2 so that a potential can be applied to cause ions to drift toward lens 22 and thus increase the fraction of ions that exit through aperture or pinhole aperture 29 of said skimmer lens 22. The ions exit from chamber 2 into associated ion optics (planar lens 30, planar entrance lens 33, extractor lens 38) used for focusing ions into the mass analyzer 34.

Adjacent to chamber 2 and along the longitudinal axis of chamber 2, inside chamber 1 at high vacuum, is an element or extractor lens 38 to which electrical potentials are applied for accelerating the ions away from the aperture 29 of skimmer lens 22. Adjacent to extractor lens 38 and along the longitudinal axis of chamber 2 and extractor lens 38, are one or more planar lenses 30 which are used to focus ions into planar entrance lens 33, from whence they proceed into the mass analyzer 34 and are detected by a detector which is normally an electron multiplier but can be a Faraday cage or other conventional device for registering the arrival of ions (not shown). A quadrupole mass filter is shown to be the mass analyzer.

The mass analyzer is located in vacuum chamber 3 which must be maintained at $10^{-5}$ torr or below for normal operation. An isolator wall 37 divides chambers 1 and 3 and contains a planar entrance lens 33. Planar entrance lens 33 is electrically isolated from isolator wall 37. Chamber 3 is evacuated through pumping port 61. In this differently pumped embodiment, higher pressures and associated gas loads can be accommodated in chamber 1 while still maintaining normal operating pressures in chamber 3.

FIG. 4 illustrates a second embodiment of the invention where chamber 2, mass analyzer 34 and associated ion optics (planar lens 30, extractor lens 38) all reside inside the same chamber, chamber 1. Chamber 1 is a region of high vacuum, evacuated through pumping port 60. In contrast to the said first embodiment (a differentially pumped system, as shown in FIG. 2), a larger pump would be required to evacuate chamber 1 through pumping port 60 to maintain a normal operating pressure of $10^{-5}$ torr or below if the same size apertures (28 and 29) for entrance lens 21 and skimmer lens 22 are used in this said second embodiment.

A third embodiment of the invention is a variation of the second embodiment, where apertures 28 and 29 for entrance lens 21 and skimmer lens 22 are smaller than those used in either the first or second embodiments. In this said third embodiment the pressure in chamber 1 could be maintained at normal operating pressure for the mass analyzer with a similar pump use in said first embodiment (a differentially pumped system). In said second and third embodiments of the invention, the planar lens 30 focuses ions directly into the mass analyzer 34 rather than through planar entrance lens 33.

REFERENCE NUMBERS IN DRAWINGS

1. chamber 1
2. chamber 2
3. chamber 3
9. tip of capillary tube
10. capillary tube
11. electrode or coaxial cylindrical tube
12. adjuster
13. vacuum seal
14. tee
15. insulator tube
16. splitter tube
17. tube
19. liquid jet
20. focusing lens
21. entrance lens
22. skimmer lens
23. insulator
24. insulator
25. chamber wall
26. heater cartridge
27. insulator
28. exit or pinhole aperture
29. aperture or pinhole aperture
30. planar lens
33. planar entrance lens
34. mass analyzer
37. isolator wall
38. extractor lens
50. gas supply source
51. gas inlet valve

52. gas tube
53. vacuum feedthrough
54. electrically insulating union
55. gas inlet tube
60. pumping port
61. pumping port
71. gas outlet valve
72. pump out line
73. vacuum feedthrough
74. electrically insulating union
75. gas outlet tube
76. liquid cone

BRIEF DESCRIPTION OF THE DRAWINGS

This invention will be described in greater detail by reference to the drawings, in which.

Figure 1:
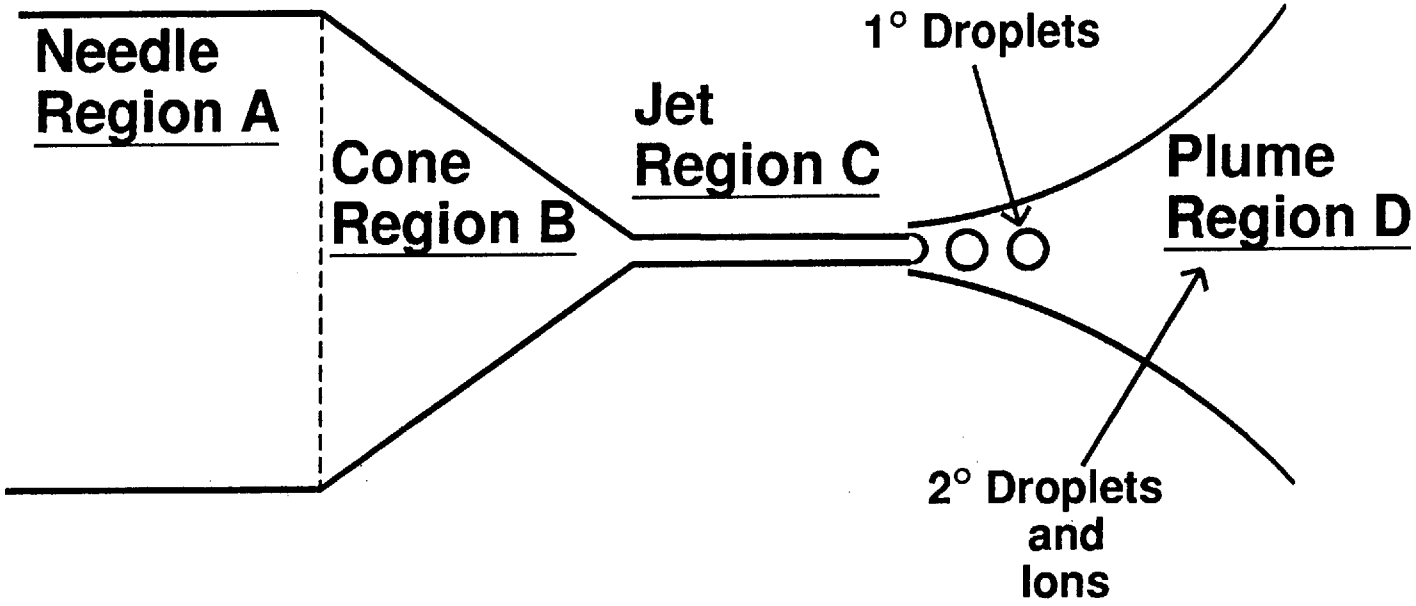
FIG. 1 is a schematic diagram of the regions (Region A: Needle, Region B: Cone, Region C: Jet, Region D: Plume) associated with electrospray aerosol generation and ionization.
Figure 2:
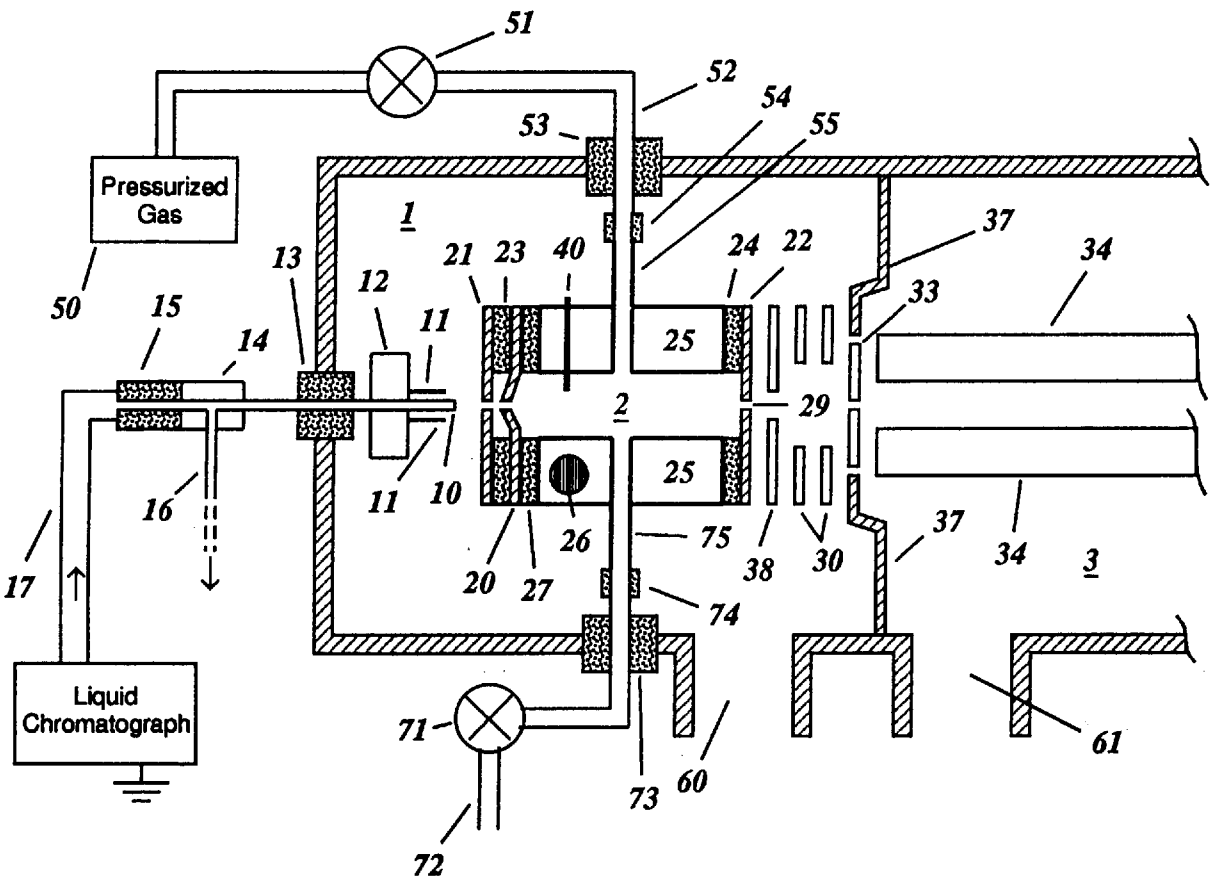
FIG. 2 is a schematic cross-sectional diagram of the present invention with a differentially pumped vacuum system in a liquid chromatography mass spectrometer implementation.
Figure 3:
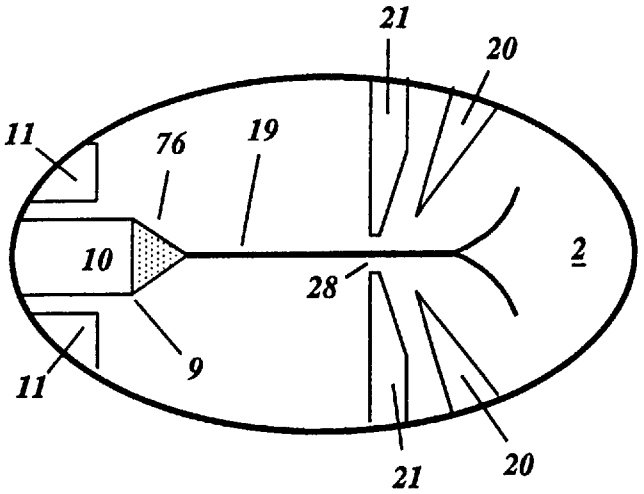
FIG. 3 is a detailed cross-sectional diagram of a preferred embodiment of the invention showing an expanded view of the capillary tube, the cone-jet in chamber 1 being steered through an entrance lens into the higher pressure chamber, chamber 2.
Figure 4:
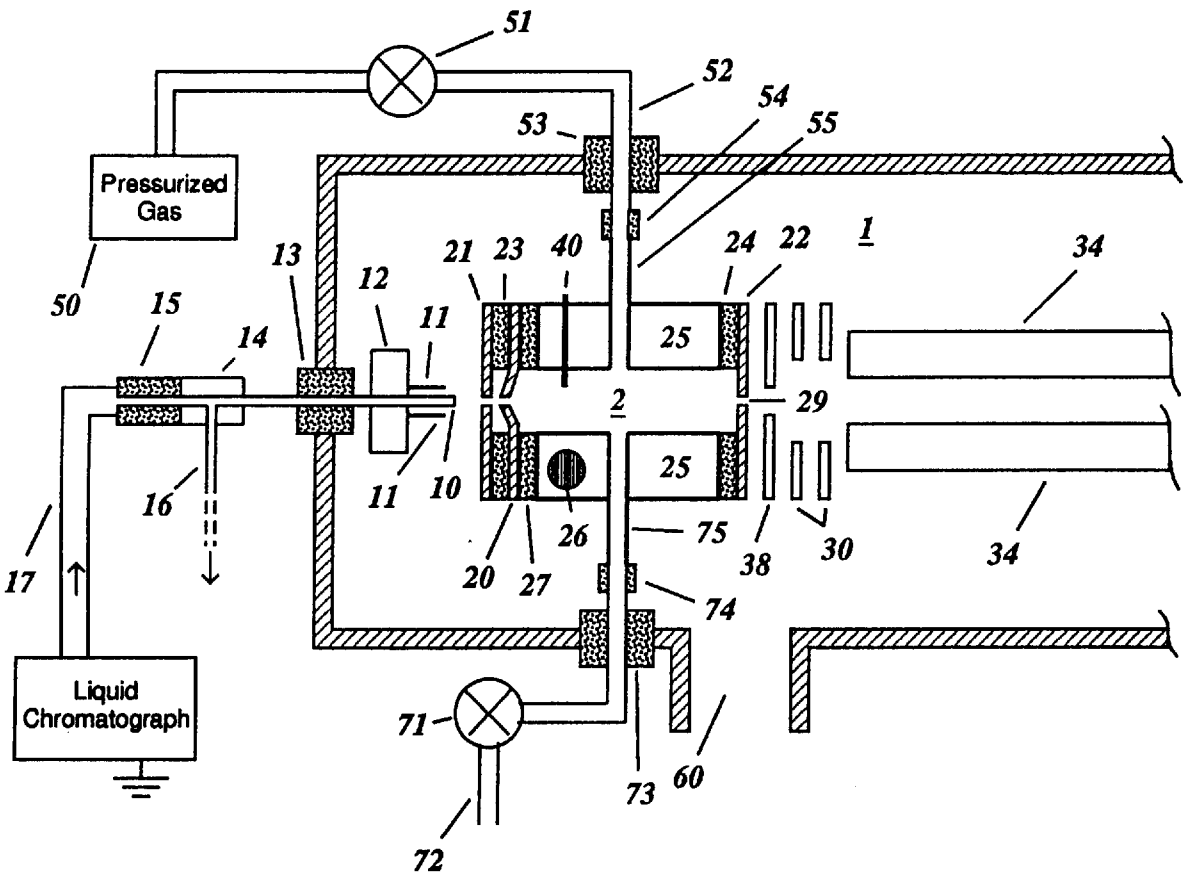
FIG. 4 is a detailed cross-sectional diagram of an alternative vacuum configuration for the present device.

I claim:

1. An apparatus for low pressure electrospray to deliver analyte to a detection device, comprising:

a) a capillary means for introducing a liquid sample;

b) a first chamber for receiving said liquid sample, said chamber includes at least a first wall in which said capillary means is situated and at least a second wall, said chamber is maintained at a pressure substantially less than atmospheric pressure;

c) a means for maintaining a high electric potential difference between said liquid sample within the capillary means and said second wall, whereby the surface of said liquid sample is distorted at the outlet of said capillary means into a single electrospray cone-jet;

d) a heating means for heating the liquid sample within the capillary means to prevent the freezing of electrospray cone-jet exiting said outlet of capillary means;

e) at least one steering means to direct said cone-jet in a well defined path;

f) an aperture disposed in said second wall of said first chamber so that the liquid jet and any resulting highly charged droplets from the breakup of the liquid jet are emitted from said first chamber;

g) a second chamber adjacent to said first chamber maintained at a pressure substantially less than atmospheric pressure and at a higher pressure than that of said first chamber, said second chamber includes said second wall of said first chamber, said aperture through which sample is emitted; and in which liquid and analyte evaporate into the gas phase so that the analyte is received by a detection device; and h) a heating means for heating said second chamber to facilitate the evaporation of said highly charged droplets.

2. The apparatus of claim 1 wherein the pressure of said first chamber is below the threshold for the initiation of a gas discharge.

3. The apparatus of claim 1 wherein the capillary means is selectively movable with respect to said second wall.

4. The apparatus of claim 1 wherein the steering means is selectively movable with respect to said capillary means.

5. The apparatus of claim 4 wherein said steering means is electrical or electromagnetic.

6. The apparatus of claim 1, further including means of adjusting the pressure of said second chamber by controlling the quantity and flow of input gas to maintain a pressure greater than the pressure of said first chamber but substantially below atmospheric pressure.

7. The apparatus of claim 6 wherein the pressure of said second chamber is between 0.1 and 10 torr.

8. The apparatus of claim 1 wherein said analyte are ions in said liquid sample.

9. The apparatus of claim 1 wherein said analyte are neutral molecules in said liquid sample.

10. The apparatus of claim 9, further including means for ionizing said neutral molecules in the gas phase by means of a high voltage discharge, electron beams, or chemical ionization processes.

11. The apparatus of claim 1, further including means for reacting analytes in the gas phase in said second chamber with reactants to generate ionic species.

12. The apparatus of claim 11 wherein said ions are subsequently subjected to pressure reduction, focussing, trapping or ion accelerating operation prior to the mass spectral analysis of an ion beam so generated.

13. The apparatus of claim 11 wherein said ions are subsequently subjected to focussing, trapping or ion accelerating operation prior to ion mobility analysis of an ion beam so generated.

14. A device for electrospraying a liquid sample containing solvent and ions for analysis by a mass spectrometer, comprising:

a) a capillary means for introducing said liquid sample;

b) a first chamber for receiving said liquid sample, said chamber includes at least a first wall in which said capillary means is situated and at least a second wall, said chamber is maintained at a pressure substantially less than atmospheric pressure;

c) a means for maintaining a high electric potential difference between said liquid sample within the capillary means and said second wall, whereby the surface of said liquid sample is distorted at the outlet of said capillary means into a single electrospray cone-jet;

d) at least one steering means to direct said cone-jet in a well defined path;

e) an aperture disposed in said second wall of said first chamber so that the liquid jet and any resulting highly charged droplets from the breakup of the liquid jet are emitted from said first chamber;

f) a heated second chamber adjacent to said first chamber, maintained at a pressure substantially less than atmospheric pressure and at a higher pressure than that of said first chamber, said second chamber includes said second wall of said first chamber, said aperture through which sample is emitted, and in which said solvent and ions evaporate into the gas phase;

g) a means of positioning the capillary means in proximity to said heated second chamber to prevent the freezing of the liquid cone-jet formed at the outlet of the capillary means; and h) a mass spectrometer downstream of said second chamber for receiving said solvents and ions in the gas-phase.

15. The device of claim 14 wherein the pressure of said first chamber is less than 0.01 torr.

16. The device of claim 14 wherein the capillary means is selectively movable with respect to said second wall.

17. The device of claim 14 wherein the pressure of said second chamber is between 0.1 and 10 torr.

18. The device of claim 17 wherein the pressure of said second chamber is about 1 torr.

19. The device of claim 14, further including a gas supply means for inputting a gas into said second chamber.

20. The device of claim 19 wherein said gas is helium.

21. The device of claim 14, further including a valve means for controlling the input and output gas to maintain a higher pressure in said second chamber greater than that of said first chamber but substantially below atmospheric pressure.

22. The device of claim 14 where ions produced in said second chamber are extracted from a chamber orthogonal to the axis of the electrospray cone-jet for subsequent mass spectrometric analysis.

23. A method for low pressure electrospray to deliver analyte to a detection device, comprising the steps of:

a) introducing a liquid sample through a capillary means;

b) receiving the sample into a first chamber which includes at least a first wall in which the capillary means for introducing the liquid sample is situated and at least a second wall, said first chamber is maintained at a substantially lower pressure than atmospheric pressure;

c) maintaining a high electric potential difference between said liquid sample within the capillary means and said second wall, whereby the surface of said liquid sample is distorted at the outlet of said capillary means into a single electrospray cone-jet;

d) heating the exit of the capillary means to prevent the freezing of the electrospray cone-jet at the outlet of capillary means;

e) steering the liquid cone-jet in a well defined path with a steering means;

f) allowing substantially all of said liquid jet and any resulting highly charged droplets from the breakup of the liquid jet through an aperture disposed in said second wall of first chamber; and g) emitting said liquid sample to a heated second chamber which includes the second wall of the first chamber, said second chamber is maintained at a pressure substantially below atmospheric pressure and at a higher pressure than that of said first chamber, said liquid evaporates into the gas phase and the analyte is received by a detection device.

24. The method of claim 23 wherein the pressure of said first chamber is maintained below the threshold for the initiation of a gas discharge.

25. The method of claim 23 wherein the capillary means is positionally adjusted relative to the steering means.

26. The method of claim 23, further includes the step of adjusting the pressure of said second chamber by controlling the quantity of input gas to maintain a pressure greater than the pressure of said first chamber but substantially below atmospheric pressure.

27. The method of claim 26 wherein the pressure of said second chamber is maintained between 0.1 and 10 torr.

28. The method of claim 23, further including the step of introducing reactive gases into said second chamber for reaction with said analytes.

29. The method of claim 23 wherein said analytes are ions in said sample.

30. The method of claim 23 wherein said analytes are neutral molecules in said sample.

31. The method of claim 30 wherein said neutral molecules are ionized in the gas phase by ion-molecule reactions.

32. The method of claim 31 wherein the ions are subsequently subjected to pressure reduction, focussing, trapping or ion accelerating operation prior to the mass spectral analysis of an ion beam so generated.

33. The method of claim 31 wherein said ions are subsequently subjected to focussing, trapping or ion accelerating operation prior to ion mobility analysis of the ion beam so generated.

* * * * *

UNITED STATES PATENT AND TRADEMARK OFFICE

CERTIFICATE OF CORRECTION

PATENT NO. : 5,838,002
DATED : November 17, 1998
INVENTOR(S) : Edward W. Sheehan It is certified that error appears in the above-identified patent and that said Letters Patent is hereby corrected as shown below:

Insert the following statement of federally funded research in between the title and the technical field section of the patent:

-- Statement Regarding Federally Funded Research

This invention was made with United States Governemnt support under a grant from the National Institutes of Health. The U.S. Government may have certain rights to this invention. --

Signed and Sealed this

Seventh Day of August, 2001

*Attest:*

Nicholas P. Godici

*Attesting Officer*

NICHOLAS P. GODICI
*Acting Director of the United States Patent and Trademark Office*